United States Patent [19]

Beckwith

[11] Patent Number: 4,706,334

[45] Date of Patent: Nov. 17, 1987

[54] COMPARTMENT LID TORQUE ROD OPENER ASSIST ASSEMBLY

[75] Inventor: John R. Beckwith, Rochester, Mich.

[73] Assignee: General Motors Corporation, Detroit, Mich.

[21] Appl. No.: 922,248

[22] Filed: Oct. 23, 1986

[51] Int. Cl.[4] ..... E05F 1/08

[52] U.S. Cl. ..... 16/308; 16/255; 16/298

[58] Field of Search ..... 16/223, 255, 258, 257, 16/300, 298, 308; 296/76

[56] References Cited

U.S. PATENT DOCUMENTS

| | | |
|---|---|---|
| 736,714 | 8/1903 | Gendron . |
| 960,629 | 6/1910 | Carroll . |
| 1,198,387 | 9/1916 | Wheary . |
| 1,213,969 | 1/1917 | Sturgis . |
| 2,894,277 | 7/1959 | Bogater et al. . |
| 2,947,025 | 8/1960 | Campbell . |
| 3,047,180 | 7/1962 | Fiala . |
| 3,211,494 | 10/1965 | Husko . |
| 3,271,066 | 9/1966 | Teague . |
| 3,476,375 | 11/1969 | Brasseur . |
| 3,525,687 | 8/1970 | Ross et al. . |

FOREIGN PATENT DOCUMENTS

| | | | |
|---|---|---|---|
| 57-84272 | 6/1982 | Japan | 296/76 |

*Primary Examiner*—Nicholas P. Godici
*Assistant Examiner*—G. M. Reid
*Attorney, Agent, or Firm*—R. L. Phillips

[57] ABSTRACT

A passenger car rear compartment lid hinge and torque rod arrangement is disclosed having both releasable and permanent torque rod holders that cooperate with the torque rod to automatically preload the latter with initial lid movement.

3 Claims, 10 Drawing Figures

COMPARTMENT LID TORQUE ROD OPENER ASSIST ASSEMBLY

TECHNICAL FIELD

This invention relates to compartment lid torque rod opener assist assemblies and more particularly to an arrangement that provides automatic torque rod preloading on assembly.

BACKGROUND OF THE INVENTION

In the typical compartment lid torque rod opener assembly such as used on passenger vehicle rear compartments, the one or more torque rods are normally manually manipulated and possibly adjusted during their assembly to obtain the desired preload in the closed lid position. This is a labor intensive operation with the mechanism, if any, for adjustment typically adding substantially to the total structure and labor cost.

SUMMARY OF THE INVENTION

The present invention combines a torque rod arrangement with a lid hinge arrangement and both releasable and permanent rod holders so as to provide an assembly wherein the rods are initially unloaded at the completion of installation with the lid open and then on first lid closure the rods are automatically conditioned and retained in the desired preloaded condition. Moreover, the rod retainers are formed so as to provide a range of preload adjustment selectable at assembly following the automatic establishment of a nominal preload.

In the preferred embodiment, a pair of torque rods are employed each having a straight portion crossing that of the other and terminating with a reverse bent portion at each end thereof. One bent portion of the rods forms a working end that hooks about and is permanently held to one of the lid hinge straps to prevent twisting of the respective rod at this end. The other bent portion of the rods forms an adjusting end that extends adjacent but not about the lid hinge strap on which the respective rod is not so permanently held. Instead, separate releasable rod holders releasably holds the adjusting end of the rods on the latter lid hinge straps at a place on the adjusting end's portion reverse bent and also at a place on the adjoining straight rod portion. Separate rod retainers are pivotally connected to the compartment for free swinging movement about a common axis parallel to that of the hinges and in the path of the adjusting end of the rods. The rod retainers each have a cam portion and a pair of notches arranged so that the former is engaged by the reverse bent portion of the associated adjusting end of one of the rods on first ever closure movement of the lid whereby to effect pivotal movement of both rod retainers in one direction to positions causing the reverse bent portion to enter one of the notches and permit the rod retainer to then swing freely in the opposite direction such that the other notch then receives the straight portion. The notches then upon slight pivotal movement of the lid in the reverse or opening direction trap the associated adjusting end and pull same from the releasable rod holders whereupon the rods then force the rod retainers again in the one direction but to a further extent so as to engage and be held by permanent rod retainer holders to the compartment whereby the rods are automatically assembled in a preloaded condition to thereafter normally urge the lid to its open position.

DETAILED DESCRIPTION OF PREFERRED EMBODIMENT

These and other objects, features and advantages of the present invention will become more apparent from the following description and drawing in which.

Figures 1, 2:
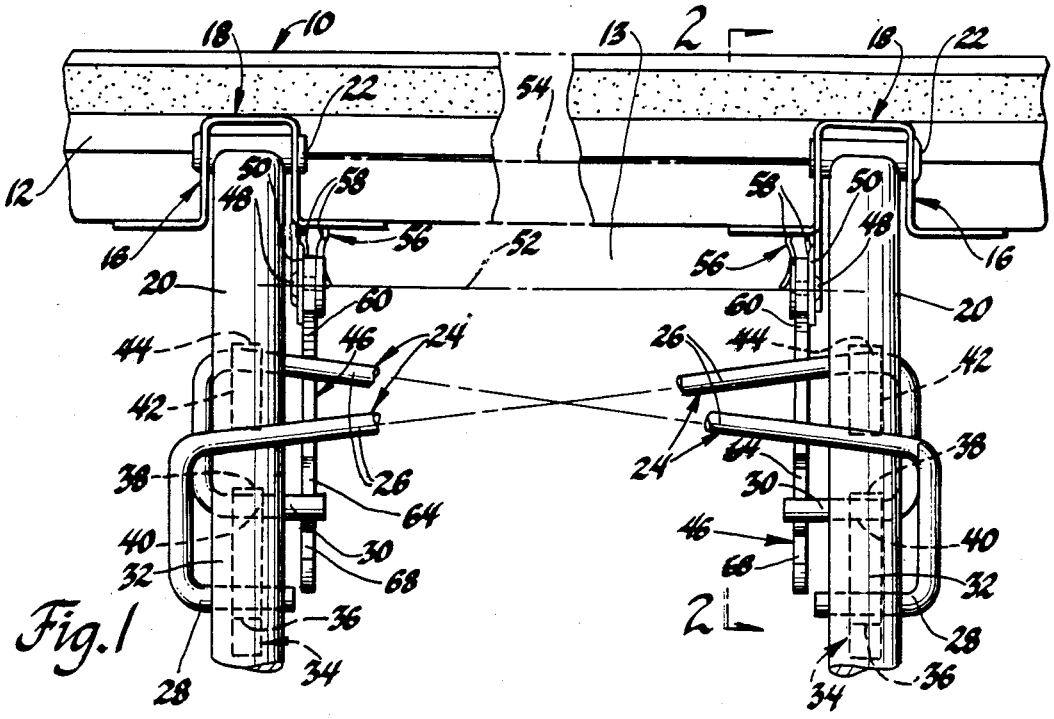
FIG. 1 is a partial rear view with parts broken away of a passenger vehicle rear compartment lid supported by the preferred embodiment of the hinge and torque rod assembly according to the present invention.
FIG. 2 is an enlarged view taken along the line 2—2 in FIG. 1.

Referring to the drawings wherein the same numbers are used throughout the several views to identify the same parts, there is shown in FIGS. 1 and 2 a passenger vehicle rear compartment 10 having an opening 12 permitting access to the interior 13 thereof. A lid 14 is pivotally connected to the compartment by a pair of laterally spaced identical hinges 16 so as to swing between open and closed positions opening and closing the compartment opening.

Each of the hinges has a strap 18 of channel cross section welded to the ceiling of the compartment adjacent the upper edge of the opening and a strap 20 of tubular cross section welded to the underside of the lid adjacent the upper transverse edge thereof. The straps are pivotally connected within the compartment outward of the opening by a hinge pin 22 that axially aligns with that of the other hinge and extends transversely of the compartment.

A pair of identical torque rods 24 each have an intermediate straight portion 26 crossing that of the other and terminating with a 180° reverse bent portion 28 and 30 at each end thereof located at the hinges. The one reverse bent portion 28 of the rods forms a working end that hooks around a 150° reverse bent portion 32 of the lid hinge straps to prevent twisting of the respective rod relative to the associated lid hinge strap. A clip 34 welded to each lid hinge strap has a semi-circular loop 36 that captures the reverse bent portion of the working end 28 of the rod at the respective hinge to hold same at a permanent location thereon. The other reverse bent portion 30 of the rods forms an adjusting end that extends adjacent but not about the lid hinge strap on which the respective rod is not so permanently located. Instead, a quarter-circle loop 38 formed on the clip 34 at the end nearer the hinge axis releasably holds the adjusting end at a place 40 on the bent portion while another but separate clip 42 also welded to the lid hinge strap but nearer the hinge axis likewise holds the rod at a place 44 on the straight portion thereof.

A pair of rod retainers 46 are pivotally connected to the interior of the compartment each by a pivot pin 48 to an inner side 50 of the respective compartment hinge straps 18. The rod retainers are located intermediate the hinges for free swinging movement about a common axis 52 parallel to the axis 54 of the hinges and in the path of the adjusting end of the respective rods. A pair of rod retainer holders 56 are also connected to the interior of the compartment by being formed integrally with the respective compartment hinge straps 18. The holders 56 are arranged in the swinging path of the respective rod retainers and are in the form of a spring clip with opposing arms 58 that are operable to grasp and hold the rod retainers as described in more detail later.

Figure 3:
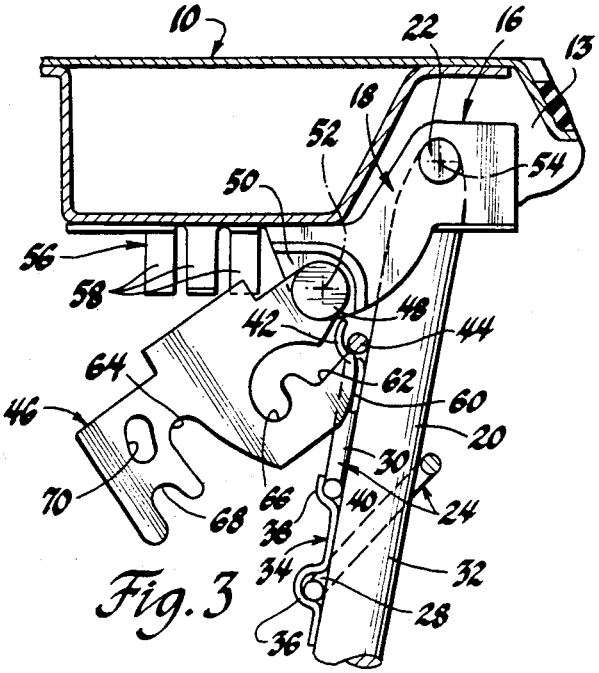
FIGS. 3–6 are views similar to FIG. 2 but showing the hinge and torque rod arrangement in sequential positions of assembly.
Figure 4:
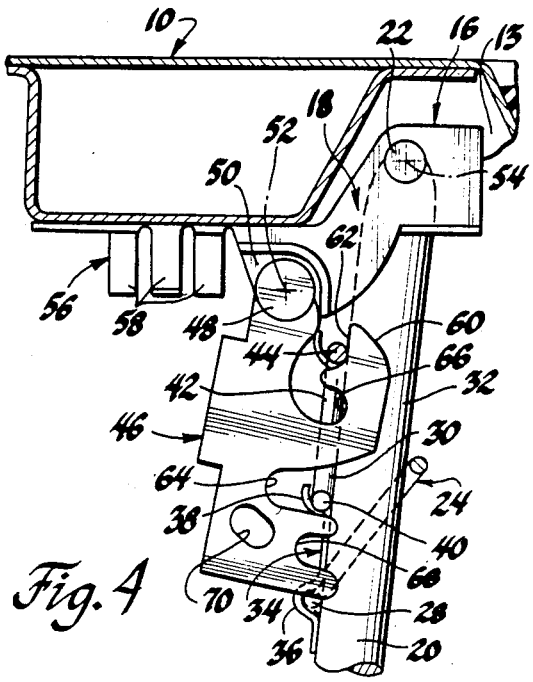
Figure 5:
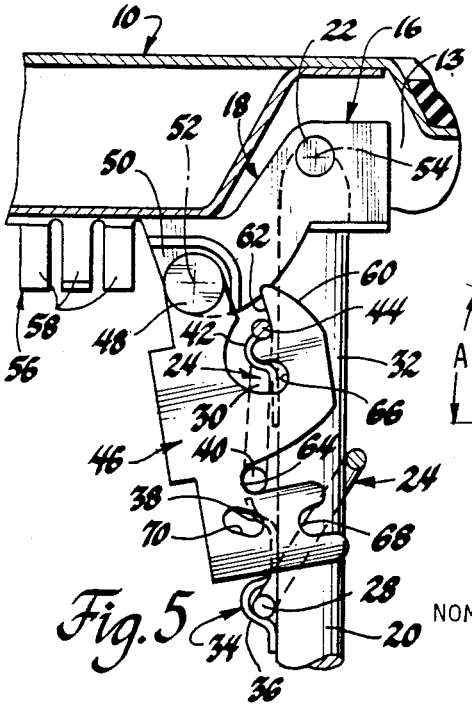
Figure 6:
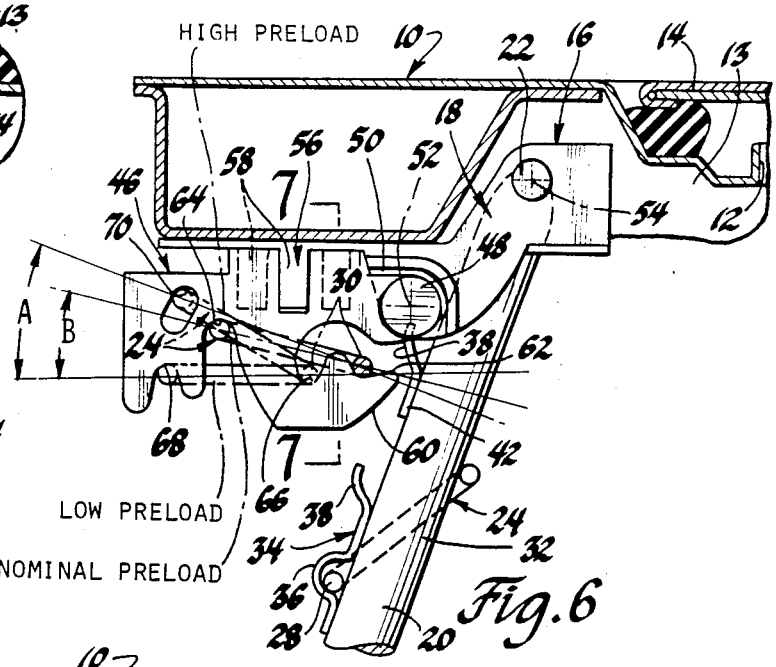
Figure 7:
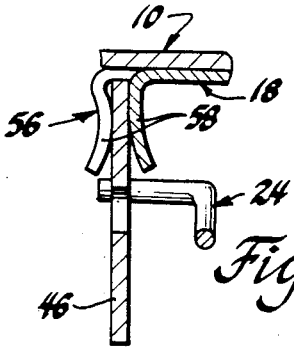
FIG. 7 is a view taken along the line 7—7 in FIG. 6.

The rod retainers 46 each have a cam portion 60, an internal notch 62 and an external notch 64 in the edge facing the rods. The cam portion and notches are arranged so that the former is engaged by the reverse bent portion of the associated adjusting end of one of the rods on first ever movement of the lid toward its closed position as shown in FIG. 3. The resulting camming action effects pivotal movement of both the rod retainers in the same direction as the lid (clockwise in the drawings) to positions causing the reverse bent portion to enter the upper notch 62 as shown in FIG. 4 and permit the rod retainers to then swing freely in the opposite direction (counterclockwise in the drawings) such that the lower notch 64 farther from the rod retainer axis then receives the straight portion of the associated rod as shown in FIG. 4. Thereafter, the notches of the respective retainers upon pivotal movement of the lid in the opposite direction toward its open position then trap the respective adjusting ends and pull same from the clips on the lid hinges straps (see FIG. 5) whereupon the rods then force the rod retainers clockwise again toward the compartment hinge straps but to a further extent so as to engage and be held by the retainer holder clips 56 to the compartment as shown in FIGS. 6 and 7 whereby the rods are automatically assembled in a preloaded nominal condition to thereafter normally urge the lid to its open position to assist the person desiring access to the compartment.

Several degrees of preload may be made available to suit different requirements and to that end there is provided on the rod retainers another internal notch 66 that combines with another external notch 68 for less preload and alternatively with an aperture 70 for more preload. For less preload, the notches 66 and 68 are horizontally aligned as seen in FIG. 6. And for more preload the notch 66 and aperture 70 lie on an angle A to the horizontal that is greater than the corresponding angle B of the notches 62 and 64.

Figure 8:
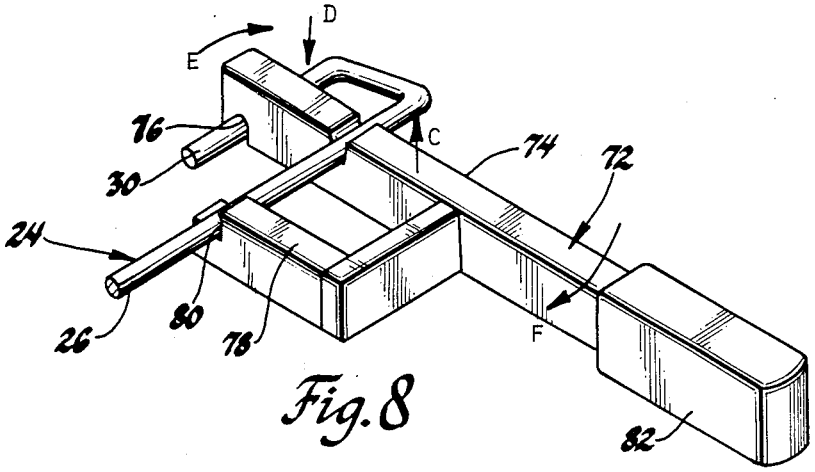
FIG. 8 is a perspective view of a tool used to adjust the torque rods from their nominal position.
Figure 9:
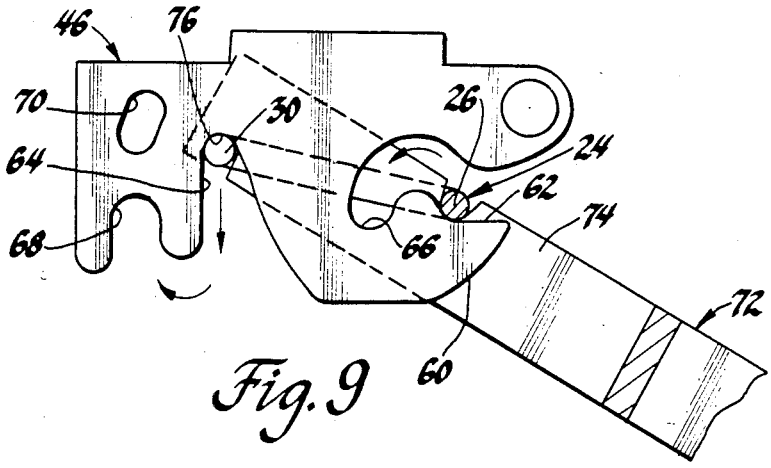
FIGS. 9 and 10 are side views showing the adjusting tool adjusting one of the torque rods from the nominal position to a second and third adjusted position respectively.
Figure 10:
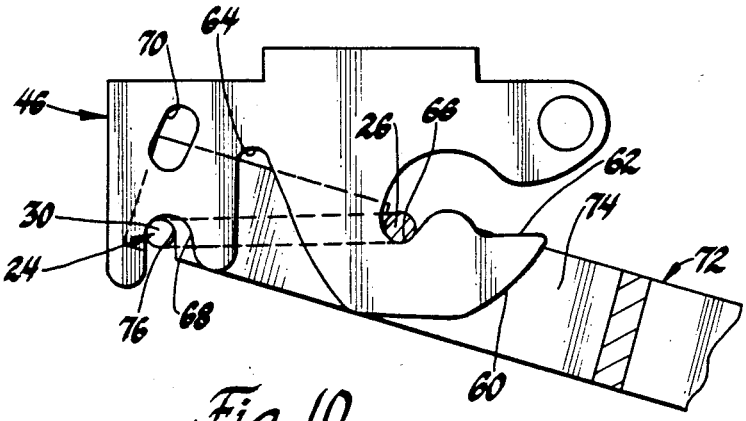

To establish less preload, the automatically obtained nominal preload is first effected as before. Then a tool 72 as shown separately in FIG. 8 having a long arm 74 with a notch 76 in one edge thereof and a short arm 78 with a notch 80 on the opposite edge thereof is applied to the adjusting end of each rod as shown in FIG. 8. The tool is grasped at its handle 82 with the long arm notch 76 engaging the reverse bent rod portion and the short arm notch 80 engaging the straight rod portion and the tool is rotated about the rod in the direction of the arrows C and D in FIG. 8 to reposition the rod for movement in the direction of the arrows in FIG. 9 from the notches 62 and 64 into the notches 66 and 68 as shown in FIG. 10. Alternatively, the tool may be rotated longitudinally of the rod in the direction of the arrows E and F in FIG. 8 while the rod is in the low preload position shown in FIG. 10 to pull the adjusting end out of the notch 68 and reposition same in the aperture 70. Furthermore, it will be appreciated that the greater preload condition may be manually established with the tool directly from the automatically established nominal preload condition. And it will also be appreciated that only one torque rod and retainer and holder may suffice for a particular application whether it be a vehicle or some other opening closure.

The above described embodiment is illustrative of the invention which may be modified within the scope of the appended claims.

The embodiments of the invention in which an exclusive property or privilege is claimed are defined as follows:

1. A compartment having an opening, a lid for covering said opening, a pair of hinges pivotally connecting said lid to said compartment so as to move between open and closed positions opening and closing said opening, each said hinge having a strap connected to said compartment and a strap connected to said lid, a torque rod having a straight portion terminating with a reverse bent portion at each end thereof, one reverse bent portion of said rod forming a working end that hooks about one of said hinge lid straps to prevent twisting of the rod relative to said one lid hinge strap, permanent rod holding means for holding the working end of said rod at a permanent location on said one lid hinge strap, the other reverse bent portion of said rod forming an adjusting end that extends adjacent but not about the other lid hinge strap, releasable rod holding means on said lid for releasably holding the adjusting end of said rod at a place on the reverse bent portion thereof and also at a place on the intermediate portion thereof, rod retaining means pivotally connected to said compartment for free swinging movement in the path of the adjusting end of said rod, rod retainer holding means on said compartment arranged in the swinging path of and operable to receive and hold said rod retaining means, said rod retaining means having a cam portion and two notches arranged so that the cam portion is engaged by the reverse bent portion of the adjusting end of the rod on first ever movement of said lid toward said closed position whereby to effect pivotal movement of both rod retaining means in one direction to a position causing the reverse bent portion to enter one of the notches and permit said rod retaining means to then swing freely in the opposite direction such that the other notch then receives the intermediate portion whereafter said notches upon pivotal movement of said lid in the reverse direction toward said open position then trap the adjusting end and pull same from said releasable rod holding means whereupon said rod then forces said rod retaining means again in said one direction but to a further extent so as to engage and be held by said rod retainer holding means to said compartment whereby said rod is assembled to thereafter normally urge said lid to its open position.

2. A compartment having an opening, a lid for covering said opening, a pair of hinges pivotally connecting said lid to said compartment so as to move between open and closed positions opening and closing said opening, each said hinge having a strap connected to said compartment and a strap connected to said lid, a pair of torque rods each having a straight portion crossing that of the other rod and terminating with a reverse bent portion at each end thereof, one reverse bent portion of both said rods forming a working end that hooks about one of said hinge lid straps to prevent twisting of the respective rod relative to the associated lid hinge strap, separate permanent rod holding means for holding the working end of said rods at a permanent location on the associated lid hinge strap, the other reverse bent portion of said rods forming an adjusting end that extends adjacent but not about the lid hinge strap on which the respective rod is non-permanently located, separate releasable rod holding means on said lid for releasably holding the adjusting end of said rods at a place on the reverse bent portion thereof and also at a place on the intermediate portion thereof, separate rod retaining means pivotally connected to said compartment for free swinging movement about a common axis parallel to that of the hinges and in the path of the adjusting end of said rods, separate rod retainer holding means on said compartment arranged in the swinging path of and operable to receive and hold said rod retaining means, said rod retaining means each having a cam portion and two notches arranged so that the cam portion is engaged by the reverse bent portion of the associated adjusting end of one of the rods on first ever movement of said lid toward said closed position whereby to effect pivotal movement of both said rod retaining means in one direction to positions causing the reverse bent portion to enter one of the notches and permit said rod retaining means to then swing freely in the opposite direction such that the other notch then receives the intermediate portion whereafter said notches upon pivotal movement of said lid in the reverse direction toward said open position then trap the associated adjusting ends and pull same from said releasable rod holding means whereupon said rods then force said rod retaining means again in said one direction but to a further extent so as to engage and be held by said rod retainer holding means to said compartment whereby said rods are assembled to thereafter normally urge said lid to its open position.

3. A compartment having an opening, a lid for covering said opening, a pair of hinges pivotally connecting said lid to said compartment so as to move between open and closed positions opening and closing said opening, each said hinge having a strap connected to said compartment and a strap connected to said lid, a pair of torque rods each having a straight portion crossing that of the other rod and terminating with a reverse bent portion at each end thereof, one reverse bent portion of both said rods forming a working end that hooks about one of said hinge lid straps to prevent twisting of the respective rod relative to the associated lid hinge strap, separate permanent rod holding means on said lid hinge straps for holding the working end of said rods at a permanent location on the associated lid hinge strap, the other reverse bent portion of said rods forming an adjusting end that extends adjacent but not about the lid hinge strap on which the respective rod is non-permanently located, separate releasable rod holding means on said lid hinge straps for releasably holding the adjusting end of said rods at a place on the reverse bent portion thereof and also at a place on the intermediate portion thereof, separate rod retaining means pivotally connected to said compartment for free swinging movement about a common axis parallel to that of the hinges and in the path of the adjusting end of said rods, separate rod retainer holding means integral with said compartment hinge straps arranged in the swinging path of and operable to receive and hold said rod retaining means, said rod retaining means each having a cam portion and two notches arranged so that the cam portion is engaged by the reverse bent portion of the associated adjusting end of one of the rods on first ever movement of said lid toward said closed position whereby to effect pivotal movement of both said rod retaining means in one direction to positions causing the reverse bent portion to enter one of the notches and permit said rod retaining means to then swing freely in the opposite direction such that the other notch then receives the intermediate portion whereafter said notches upon pivotal movement of said lid in the reverse direction toward said open position then trap the associated adjusting ends and pull same from said releasable rod holding means whereupon said rods then force said rod retaining means again in said one direction but to a further extent so as to engage and be held by said rod retainer holding means to said compartment whereby said rods are assembled to thereafter normally urge said lid to its open position.

* * * * *